US005783909A

United States Patent [19]

Hochstein

[11] Patent Number: 5,783,909

[45] Date of Patent: Jul. 21, 1998

[54] MAINTAINING LED LUMINOUS INTENSITY

[75] Inventor: Peter A. Hochstein, Troy, Mich.

[73] Assignee: Relume Corporation, Troy, Mich.

[21] Appl. No.: 781,688

[22] Filed: Jan. 10, 1997

[51] Int. Cl.[6] ..... H05B 37/02

[52] U.S. Cl. ..... 315/159; 315/158; 315/169.3; 315/224; 315/307; 363/89

[58] Field of Search ..... 315/307, 224, 315/169.3, 154, 155, 158, 159; 250/214 R, 214.1, 214 AL, 214 C; 363/80, 89, 126, 26, 36, 41

[56] References Cited

U.S. PATENT DOCUMENTS

| | | | |
|---|---|---|---|
| 1,662,348 | 3/1928 | Stricker . | |
| 2,503,574 | 4/1950 | Allen | 40/132 |
| 3,919,546 | 11/1975 | Lutus | 250/205 |
| 4,587,459 | 5/1986 | Blake | 315/158 |
| 5,661,645 | 8/1997 | Hochstein | 363/89 |

OTHER PUBLICATIONS

Hewlett Packard Application Brief I–012 Temperature Compensation Circuit for Constant LED Intensity, May 1995.

*Primary Examiner*—Benny T. Lee
*Assistant Examiner*—Haissa Philogene
*Attorney, Agent, or Firm*—Howard & Howard

[57] ABSTRACT

A circuit for maintaining the luminous intensity of a light emitting diode (LED) (12) comprising at least one light emitting diode (LED) (12) for producing an luminous intensity; a sensor (22,24) for sensing a condition proportional to the luminous intensity of the LED (12) and for producing a luminous intensity signal; a power supply (16) electrically connected to the LED (12) for supplying pulses of electrical energy to the LED (12); and wherein the power supply (16) includes a switching device responsive to the luminous intensity signal for adjusting the electrical energy supplied by the pulses per unit of time to adjust the average of the current passing through the LED (12) to maintain the luminous intensity of the LED (12) at a predetermined level. In one instance, the sensor (22) includes means for sensing changes in the operating temperature of the LED (12). In a second instance, the sensor (24) includes means (28) for sensing changes in luminous output of the LED (12). The electrical energy supplied by the pulses per unit of time are adjusted by anyone of (1) varying the frequency, (2) varying the width of the pulses, (3) a combination of frequency and width, or (4) adjusting the phase of the pulses within an a.c. sinusoidal wave form.

18 Claims, 3 Drawing Sheets

MAINTAINING LED LUMINOUS INTENSITY

TECHNICAL FIELD

The subject invention relates to light emitting diodes (LEDs).

BACKGROUND OF THE INVENTION

The increasing use of light emitting diode (LED) signals in a variety of outdoor environments has presented some serious deficiencies in the LED technology. Traffic signals, outdoor message boards, railroad crossing signs, and similar safety critical signals have been converted from incandescent lamps to LED designs to take advantage of the energy savings and long service life provided by LED devices. In some situations, however, the LED devices have not performed satisfactorily and, in fact, can present a safety hazard due to diminution of luminous output.

It is well known that the luminous output of LED devices degrades with time and temperature. Degradation is generally a linear function of time whereas degradation is an exponential function of temperature. At elevated temperature, circa 85° C., certain LEDs exhibit a permanent degradation or loss of luminous output of approximately forty percent (40%) in twenty thousand (20,000) hours of use. This degradation must be factored into the design of safety critical signals so that, at the end of specified service life, some minimum luminous intensity is still available.

Another, less appreciated fact is that most LEDs also exhibit a non-permanent or recoverable diminution of luminous output with increasing temperature. Typically, a loss of approximately one percent (1%) of intensity with every one degree Centigrade (1° C.) increase in temperature is observed in certain commercially available LEDs.

The non permanent temperature induced diminution of LED luminous output has only recently been formally acknowledged and is clearly set forth in Hewlett Packard Application Brief 1-012 (document 5963-7544E 5/95).

One solution to this temperature induced diminution is suggested by the cited 1-012 reference. This document recommends linearly controlling the current through an LED by means of a linear feedback control system. The sensing element in this feedback control circuit is a photodiode that monitors the luminous output of the illuminated LED. While this proposed solution is theoretically workable, practical application of this principle is very difficult and inefficient.

Firstly, any optical sensor used to monitor the powered LED must be shielded from ambient light, which would be added to LED luminous output, and "confuse" the feedback control system. The influence of extraneous, ambient light is of particular concern in outdoor applications where the light level might change substantially over time. The sensor could be closely coupled to one LED in an array of LEDs and be fully shielded from extraneous light, but isolating one emitter (LED) in a closely packed array is difficult if all operating variables (such as temperature) are to be identical.

Secondly, any linear current control system is intrinsically dissipative and inefficient. The linear or regulating control element in such circuits necessarily acts as a resistive element to reduce current flow to the LED(S) when less light output is required. When a larger current through the LED (S) is dictated by the control circuit, the linear control element effectively reduces its resistance to current. Typically such current control elements are transistors of various types, which must dissipate the controlled current multiplied by the voltage drop across the control element as heat. That is, power not utilized by the LED(S) is dissipated as heat when less current through the LED is indicated.

SUMMARY OF THE INVENTION AND ADVANTAGES

A circuit for maintaining the luminous intensity of a light emitting diode including at least one light emitting diode (LED) for producing a luminous intensity. A sensor for sensing a condition proportional to the luminous intensity of the LED and for producing a luminous intensity signal. A power supply electrically connected to the LED for supplying pulses of electrical energy to the LED. The power supply includes a switching device responsive to the luminous intensity signal for adjusting the electrical energy supplied by the pulses per unit of time to adjust the average of the current passing through the LED to maintain the luminous intensity of the LED at a predetermined level.

The invention also includes a method of maintaining the luminous intensity of a light emitting diode (LED) comprising the steps of supplying pulses of electrical energy from an adjustable power supply to an LED for establishing electrical current passing through the LED; sensing a condition proportional to the luminous intensity of the LED; and adjusting the electrical energy supplied by the pulses per unit of time to adjust the average of the current passing through the LED to maintain the luminous intensity of the LED at a predetermined level.

The present invention will compensate for the diminution of light output from LED signals due to temperature, either as operating temperature varies and/or to compensate for diminution of light output due to permanent temperature induced degradation, i.e., aging.

In all embodiments, the subject invention increases the average current through the LED to compensate for a loss of luminous output, and vice versa.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
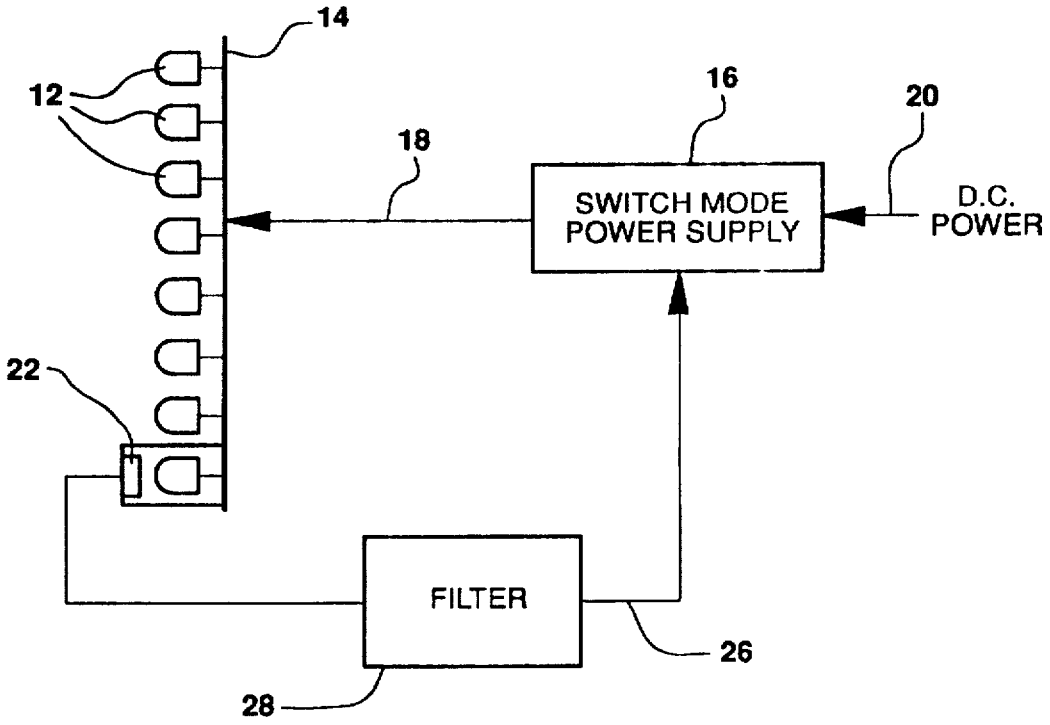
FIG. 1 is a schematic view of a first embodiment.
Figure 2:
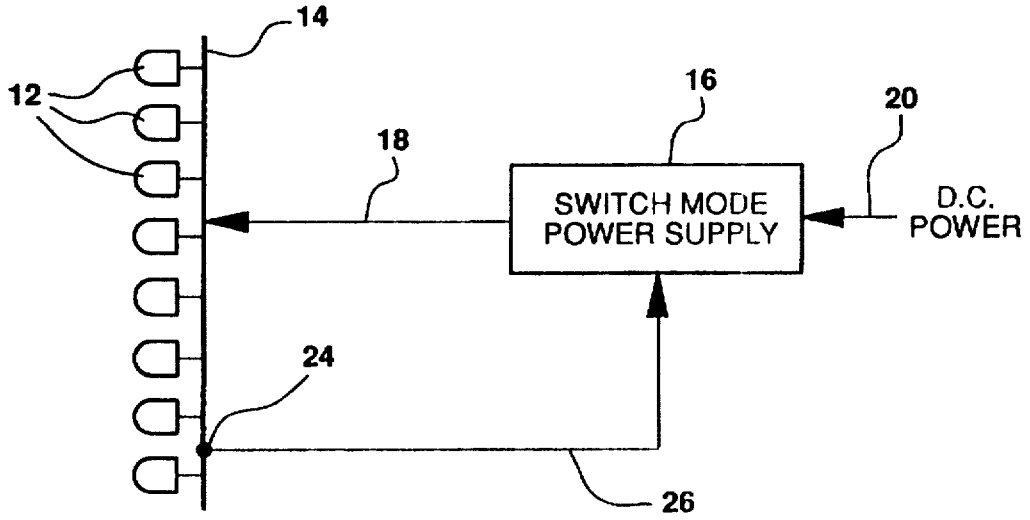
FIG. 2 is a schematic view of a second embodiment.
Figure 5:
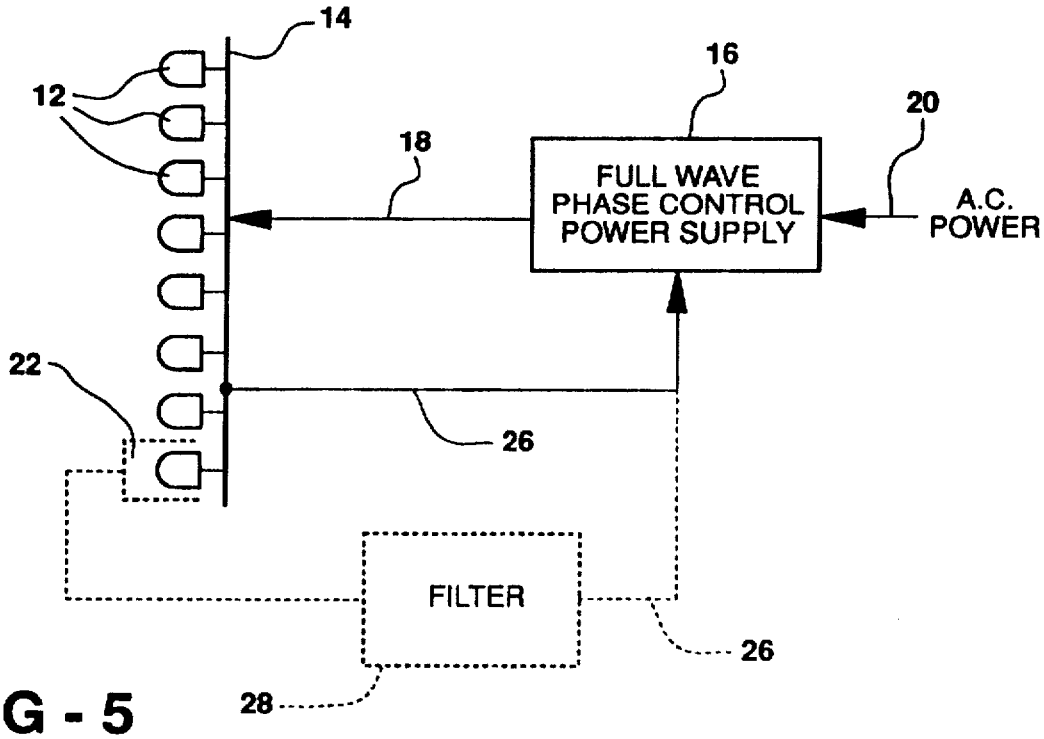
FIG. 5 is a schematic view of a third embodiment.

Referring to the Figures, wherein like numerals indicate like or corresponding parts throughout the several views, a first embodiment of a circuit for maintaining the luminous intensity of a light emitting diode is shown schematically in FIG. 1, a second embodiment is shown in FIG. 2, and a third embodiment is shown in FIG. 5.

In each embodiment there is included an array of light emitting diodes 12, each of which is hereinafter referred to as an LED. The LEDs are mounted on a circuit board 14 as is well known in the art. The invention includes to at least one LED but normally comprises a plurality of LEDs electrically connected in series and/or parallel on a circuit board 14.

An adjustable power supply 16 is electrically connected via a lead 18 to the LED array for adjusting the average current passing through the LEDs 12. The power supply 16 is connected via a lead 20 to a source of electrical power, d.c. power in the embodiments of FIGS. 1 and 2, and a.c. power in embodiment of FIG. 3. The adjustable power supply 16 may adjust voltage or current, but in either case it is the average current passing through the LEDs that controls the luminous output of the LEDs. Such power supplies include a means for switching and may be adjustable in response to a signal from a sensor. Even in cases where a pulse width modulated power supply 16 is employed, changing the pulse width or the pulse rate (frequency) as a function of operating temperature will change the average current through the LED array, and thus the average luminous output. The power supply 16 includes a switching device responsive to the luminous intensity signal for adjusting the electrical energy supplied by the pulses per unit of time to adjust the average of the current passing through the LED 12 to maintain the luminous intensity of the LED 12 at a predetermined level.

Both embodiments include a sensor 22 or 24 electrically connected via a lead 26 to the power supply 16 for sensing a condition proportional to the luminous intensity of the LEDs and for sending a signal to the power supply 16 to increase the average current passing through the LEDs to maintain the luminous intensity of the LEDs at a predetermined level.

In the embodiment of FIG. 1, the sensor 22 includes means for sensing changes in luminous output of the LED array. The sensor 22 also includes means 28 for differentiating ambient light from the luminous output of the LED array for measuring the actual luminous output of the LED without the influence of ambient light. The light sensing modulator 22 includes a light sensing transducer which is coupled to one or more of the LEDs in the array to measure the actual light output of the LED array under all operating conditions. The sensitivity of the light detector 22 to ambient light is minimized by shielding or close coupling of the sensor 22 to the LEDs. More specifically, a collimator or tube 28 could be used to block out ambient light so that the light sensor 22 only sees the luminous output of the LEDs. Alternatively, in the pulsed LED signal, synchronous detection could be employed to differentiate between ambient light and the LED output plus ambient light. The differential signal may then be employed to modulate the LED array average current to keep the output luminous intensity essentially constant. Such closed loop control, with the proper feedback time constants, will assure an essentially constant luminous output irrespective of operating temperature.

In the embodiment of FIG. 2, the sensor 24 includes means for sensing changes in temperature of the LEDs. A temperature sensitive element, such as a thermistor, a thermocouple, a temperature sensing semiconductor, or the like, is used to program the voltage or current output of the power supply 16 to provide more average current passing through the LEDs in response to temperature rise. The transfer function or gain or rate at which the average operating current passing through the LEDs is increased as a function of temperature is based upon a predetermined LED behavior model. This behavior model establishes the necessary increase in the average operating current through the LEDs as a function of operating temperature of the LEDs in order to keep the luminous output of the LED array essentially constant at a predetermined level. Accordingly, the sensor 22 includes a predetermined temperature behavior model to establish the increase in the current passing through the LED array as a function of the operating temperature of the LED array integrated with the predetermined temperature behavior model. This behavior model may be pre-programmed into a chip.

Figure 3A:
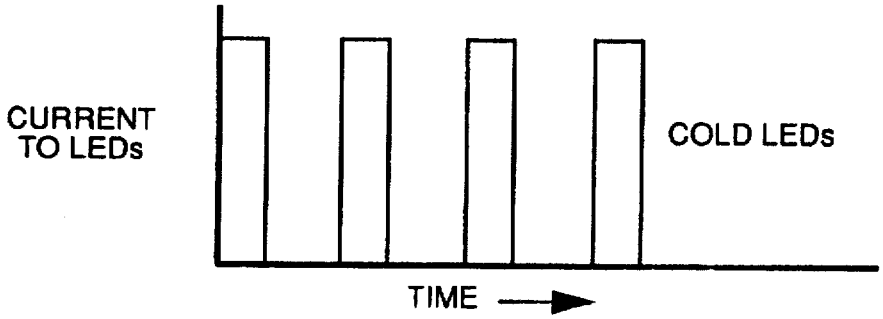
FIG. 3 is a graph showing variation in the width of the electrical pulses.
Figure 3B:
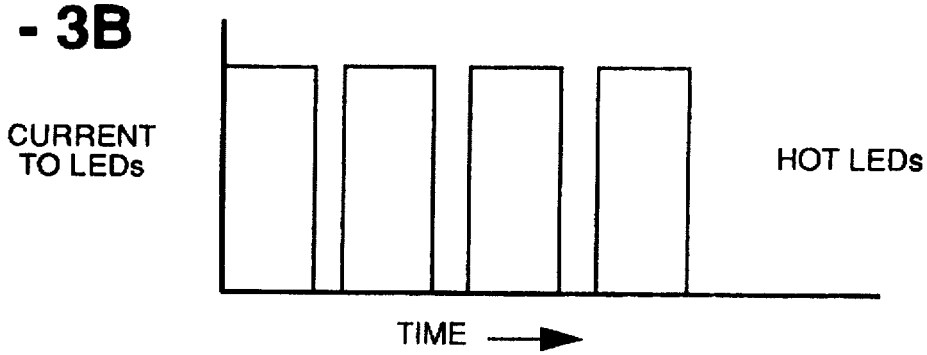
Figure 4A:
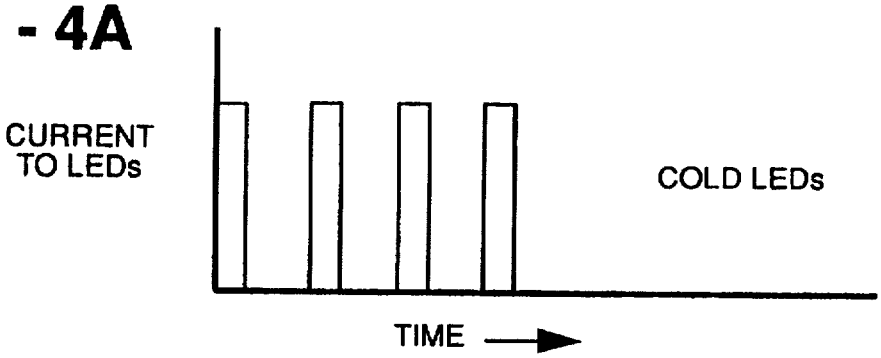
FIG. 4 is a graph showing variation in the frequency of the electrical pulses.
Figure 4B:
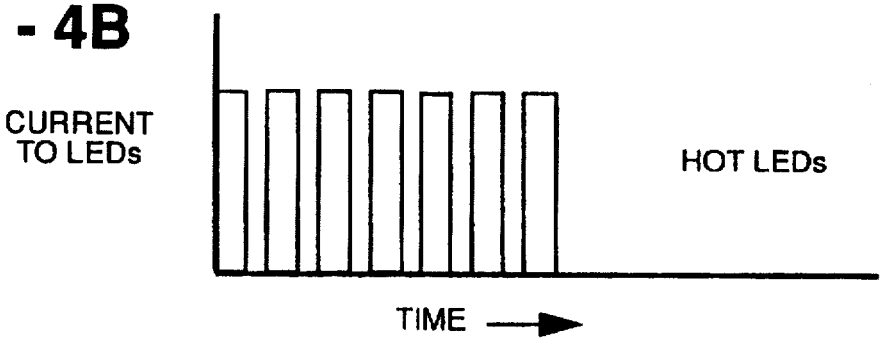

The switching device of the power supply 16 may include means for adjusting the electrical energy supplied by said pulses per unit of time by adjusting the width of said pulses as illustrated in FIG. 3. On the other hand, the switching device includes means for adjusting the electrical energy supplied by the pulses per unit of time by adjusting the frequency of the pulses as illustrated in FIG. 4. In the embodiment of FIG. 5, the switching device includes means for adjusting the electrical energy supplied by the pulses per unit of time by adjusting the phase of the pulses within an a.c. sinusodial wave form.

Therefore the invention includes a method of maintaining the luminous intensity of a light emitting diode (LED) comprising the steps of supplying pulses of electrical energy from an adjustable power supply 16 to an LED 12 for establishing electrical current passing through the LED 12; sensing 22,24 a condition proportional to the luminous intensity of the LED 12; and adjusting the electrical energy supplied by the pulses per unit of time to adjust the average of the current passing through the LED 12 to maintain the luminous intensity of the LED 12 at a predetermined level.

In the first embodiment, the sensing of a condition is further defined as sensing changes in temperature of the LED. This step may be further perfected by establishing a predetermined temperature model and increasing the current passing through the LED as a function of the operating temperature of the LED integrated with the predetermined temperature model.

In the second embodiment, the sensing of a condition is further defined as sensing changes in luminous output of the LED. This step may be further defined as differentiating ambient light from the luminous output of the LED for measuring the actual luminous output of the LED without the influence of ambient light.

The present invention relates to a new method of maintaining an essentially constant luminous output from an LED array, irrespective of operating temperature. Unlike the proposed method in the cited reference, using linear regulation of the LED current, the present invention uses pulse width modulation or frequency variation, or a combination thereof, of a power source to control the average current through the LED(s).

It is well known that switch mode operation of power supplies is very efficient. It is also widely recognized that control of power supply output voltage or output current is most efficiently accomplished by varying the pulse width or frequency of the switched waveform. Normally, d.c. power supplies filter the switched output voltage to produce a constant, relatively ripple free output.

LED arrays, particularly those used in outdoor environments such as message boards, traffic signals and automotive tail lights are subject to severe temperature excursions. As discussed, the higher temperatures diminish the luminous output of the LEDs if they are operated at constant current. The primary purpose of the present invention is to increase the average current through the LED array with increasing temperature, by adjusting the pulse width or frequency of LED switch mode power supply.

Figure 6A:
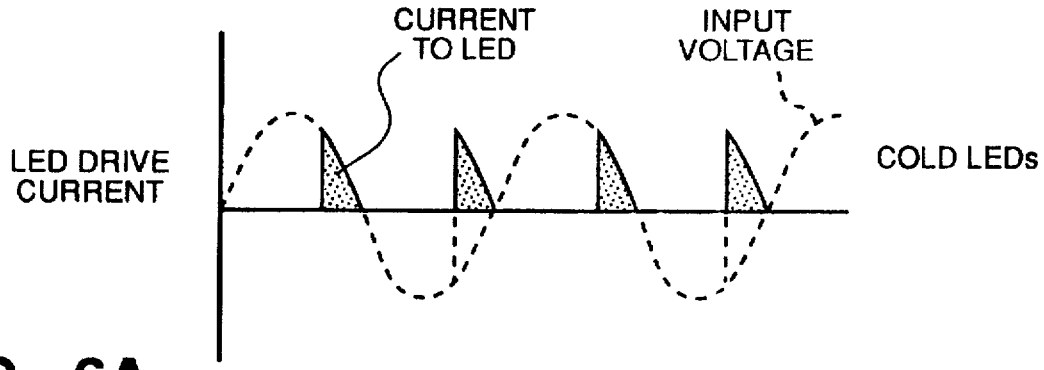
FIG. 6 is a graph showing variation in the sinusodial wave form of the third embodiment.
Figure 6B:
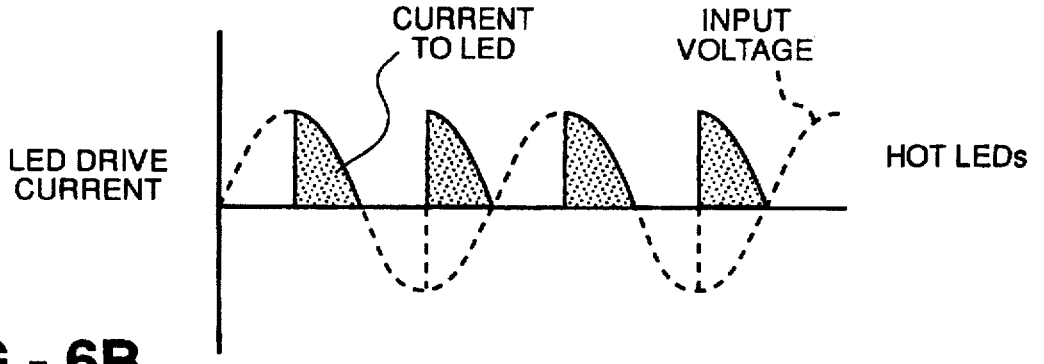

It will be appreciated that such a switch mode power supply can take many forms. Within the scope of the present invention, switch mode supplies include any power source 16 that is turned on and off at a frequency consistent with the other operating parameters of the system. Typically, the switching frequency would extend from 60 Hz to over 50 KHz. The use of traditional phase controlled a.c. power supplies as illustrated in FIGS. 5 and 6, is also explicitly included as a suitable power supply. While not generally considered switch mode in the narrowest sense, phase controlled supplies will provide very efficient, variable pulse width, variable average current to the LED array. In other words, for the purpose of this invention, phase controlled power supplies are considered to be a variant of switch mode supplies.

Two sensor means are contemplated by the present invention: Light sensing 22 the output of the LED array or a representative LED in that array, or temperature 24 sensing of the LED array. Either type of sensor can be used to modulate the average current through the LED array to maintain essentially constant luminous output, irrespective of operating temperature.

As shown in FIG. I, the basic feedback control system is configured to sense the light output from one or more LEDs, with a light sensitive transducer 22 such as a photodiode that will program or modulate the average output current of the switch mode power supply. The use of a filter circuit 28 for the light sensing transducer may be necessary to accommodate the pulsing light output from the LED array. Of course, the pulsing current delivered by the power supply could be filtered to essentially d.c., making the transducer filter unnecessary. In either case, the average current delivered to the LED is varied to compensate for a change in LED luminous output. This change in output may be due to permanent degradation and/or temperature induced diminution. The light sensing transducer 22 will compensate for the aggregate light loss and maintain the luminous output essentially constant at a predetermined level. Accordingly, a filter is included for filtering the output of the power supply 16 for averaging the luminous intensity of the LED.

FIG. 2 shows a LED array, feedback control system that will maintain an LED array at a nominal constant luminous output by sensing the operating temperature of the array. A temperature sensing transducer 24 such as a thermistor, semiconductor device or thermocouple is used to program or modulate the average current of a switch mode power supply that drives the LED array. Temperature compensation of the LEDs is easier to implement than optical feedback because ambient light no longer presents any interference. Also, temperature changes are relatively slow so that operating the LEDs in pulsed mode will not require temperature sensing transducer filtering. Of course, long term degradation of LED luminous output cannot be compensated for by simple temperature compensation schemes.

More sophisticated temperature compensation topologies that do take into account the permanent 'time at temperature' degradation mechanisms plus the instantaneous diminution of luminous output due to temperature are indeed possible. Such a comprehensive compensation approach using temperature sensors could be implemented if the degradation mechanisms of the LEDs were carefully modeled. In such a comprehensive case, the average current drive to the LED array would still varied according to mathematical models describing the time-temperature induced variation in luminous output and the equation describing the instantaneous diminution with temperature.

While the power input to the switch mode power supply in both FIGS. I and 2 is shown as d.c., the switch mode supply could easily be operated on a.c. by using common rectifier means.

FIG. 3 shows the well known, constant or fixed frequency, variable pulse width modulation of average drive current. When cold, the LEDs deliver more lumens per average current (mA), so that a lower average current or pulse width is necessary to maintain a prescribed light output. In order to maintain essentially this same light output at higher temperatures, the pulse width of the switch mode power supply is increased, thereby increasing the average current, thus maintaining the prescribed light output. FIG. 4 shows the adjustment of average current using a fixed pulse width, variable frequency modulation scheme. Functionally, the result of either form of switch mode modulation is the same, in that the average current to the LED array is varied according to a sensed parameter, i.e., either light or temperature.

For applications where a.c. powered LED arrays are suitable, direct phase control of the a.c. line is also feasible, and is similar to fixed frequency, pulse width modulation. Once again, the average current to the LED array is varied or modulated in response to a measured process parameter: Temperature or luminous output of the LEDs.

As shown in FIG. 5., an LED array is powered by a phase angle modulated, full wave, rectified a.c. controller similar to traditional triac or silicon controlled rectifier "light dimmers". Of course instead of a control potentiometer to vary the phase angle for changing the average output current, the width of the output pulses is controlled by either a light detector or temperature sensor. Unlike most common a.c. power controllers the circuit of FIG. 5, employs full wave rectification for efficient flicker free performance of the LED array.

Shown in FIG. 6 are the phase controlled wave forms that could be expected for hot and cold LED operating environments. Naturally, the pulsing output could be filtered if necessary to provide d.c. operation of the LED array if desired.

The transfer function of the feedback control systems for the present invention are device specific and would be engineered for particular families of LEDs. That is, in the case of temperature compensated LED arrays, the actual diminution of luminous output per degree of temperature increase would be used program the correct increase in average LED current. In the case of optical sensing, the feedback loop is essentially closed, and only loop gain and response time need be set.

It is important to note that either the light sensing or temperature sensing feedback control scheme is viable only if the LEDs incorporate adequate heat rejection. LEDs that are not adequately heat sinked could exhibit destructive thermal runaway if the drive current is not limited.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A circuit for maintaining the luminous output of a light emitting diode, said circuit comprising:

at least one light emitting diode (LED) (12) for producing a luminous output;

a sensor (22,24) for sensing a condition proportional to said luminous output of said LED (12) and for producing a luminous output signal;

a power supply (16) electrically connected to said LED (12) for supplying ON/OFF pulses of electrical energy to produce the luminous output of said LED (12); and said power supply (16) including a switching device responsive to said luminous output signal for adjusting the electrical energy supplied by said pulses per unit of time to adjust the average of said current passing through said LED (12) to maintain the luminous output of said LED (12) at a predetermined level.

2. A circuit as set forth in claim 1 wherein said sensor (22) includes means for sensing changes in temperature of said LED (12).

3. A circuit as set forth in claim 2 wherein said sensor (22) includes a predetermined temperature behavior model to establish the increase in said current passing through said LED (12) as a function of the operating temperature of said LED (12) integrated with said predetermined temperature behavior model.

4. A circuit as set forth in claim 1 wherein said sensor (24) includes means (28) for sensing changes in luminous output of said LED (12).

5. A circuit as set forth in claim 4 wherein said sensor (24) includes means (30) for differentiating ambient light from the luminous output of said LED (12) for measuring the actual luminous output of said LED (12).

6. A circuit as set forth in claim 1 wherein said switching device includes means for adjusting the electrical energy supplied by said pulses per unit of time by adjusting the frequency of said pulses.

7. A circuit as set forth in claim 1 wherein said switching device includes means for adjusting the electrical energy supplied by said pulses per unit of time by adjusting the width of said pulses.

8. A circuit as set forth in claim 1 wherein said switching device includes means for adjusting the electrical energy supplied by said pulses per unit of time by adjusting the phase of said pulses within an a.c. sinusoidal wave form.

9. A circuit as set forth in claim 1 including a filter for filtering the electrical energy supplied by said pulses into substantially d.c. supplied to said LED for producing said luminous output.

10. A method of maintaining the luminous output of a light emitting diode (LED) comprising the steps of:

supplying ON/OFF pulses of electrical energy from an adjustable power supply (16) for establishing electrical current passing through the LED (12);

sensing (22,24) a condition proportional to the luminous output of the LED (12); and adjusting the electrical energy supplied by the ON pulses per unit of time to adjust the average of the current passing through the LED (12) to maintain the luminous output of the LED (12) at a predetermined level.

11. A method as set forth in claim 10 wherein sensing a condition is further defined as sensing changes in temperature of the LED (12).

12. A method as set forth in claim 10 further defined as establishing a predetermined temperature behavior model and increasing the current passing through the LED (12) as a function of the operating temperature of the LED (12) integrated with the predetermined temperature behavior model.

13. A method as set forth in claim 10 wherein sensing a condition is further defined as sensing (28) changes in luminous output of the LED (12).

14. A method as set forth in claim 13 further defined as differentiating (30) ambient light from the luminous output of the LED (12) for measuring the actual luminous output of the LED (12) without the influence of ambient light.

15. A method as set forth in claim 10 further defined as adjusting the electrical energy supplied by said pulses per unit of time by adjusting the frequency of said pulses.

16. A method as set forth in claim 10 further defined as adjusting the electrical energy supplied by said pulses per unit of time by adjusting the width of said pulses.

17. A method as set forth in claim 10 further defined as adjusting the electrical energy supplied by said pulses per unit of time by adjusting the phase of said pulses within an a.c. sinusodial wave form.

18. A method as set forth in claim 10 including filtering the output of the power supply for filtering the electrical energy supplied by said pulses into substantially d.c. supplied to the LED for producing said luminous output.

* * * * *